United States Patent [19]

Binstock et al.

[11] 4,306,417

[45] Dec. 22, 1981

[54] MULTIPLE BOILER STEAM BLENDING CONTROL SYSTEM FOR AN ELECTRIC POWER PLANT

[75] Inventors: Morton H. Binstock, Pittsburgh, Pa.; Robert L. Criswell, Florham Park, N.J.

[73] Assignees: Westinghouse Electric Corp., Pittsburgh, Pa.; Foster Wheeler Energy Corp., Livingston, N.J.

[21] Appl. No.: 98,106

[22] Filed: Nov. 28, 1979

[51] Int. Cl.[3] ..... F01K 13/02

[52] U.S. Cl. ..... 60/676

[58] Field of Search ..... 60/660, 676, 646, 657

[56] References Cited

U.S. PATENT DOCUMENTS 2,918,798 12/1959 Schroder ..... 60/676

4,060,990 12/1977 Guido et al. ..... 60/676

*Primary Examiner*—Allen M. Ostrager

*Attorney, Agent, or Firm*—E. F. Possessky; Marvin A. Naigur

[57] ABSTRACT

A steam blending control is provided for two or more boilers in an electric power plant. To blend an oncoming boiler with an on-line boiler, the oncoming boiler is fired to a pressure ramp setpoint and outlet steam is isolated from the plant turbine and directed through position controlled bypass valve means. When steam temperature and pressure conditions are matched, the oncoming boiler isolation valve is opened and the bypass flow then existing is stored in a memory. The oncoming boiler bypass flow is cut back with total oncoming boiler steam flow controlled to the memorized flow valve as a setpoint. Flow from the on-line boiler is cut back under load control as the oncoming boiler flow to the plant turbine is increased. Deblending is implemented in a similar manner.

5 Claims, 9 Drawing Figures

MULTIPLE BOILER STEAM BLENDING CONTROL SYSTEM FOR AN ELECTRIC POWER PLANT

BACKGROUND OF THE INVENTION

The present invention relates to electric power plants and more particularly to systems for controlling the blending of steam outputs from multiple steam generators in such plants.

In the operation of fossil fired power plants, plant availability can be significantly enhanced through the provision of one or more backup steam generators or boilers. For example, a plant may be provided in its original design or in a retrofit design with two boilers for one turbine or three boilers for two turbines. In addition to functioning as a backup replacement, a backup boiler may be operated with the primary boiler to supplement the generating capacity of the plant.

One of the primary causes of lengthy boiler shutdowns is the need to repair water leaks resulting from water tube corrosion. With increasing installation of coal fired plants as opposed to gas or oil fired plants, water corrosion becomes more problematical because of sulfuric acid, slagging and other corrosive effects of burning coal. Therefore, the need for steam blending plant designs and steam blending controls for such plants increases with increased installation of coal fired plants.

Power plants having provision for steam mixing have been disclosed previously. For example, a steam mixing system is disclosed in U.S. Pat. No. 4,060,990 issued to P. V. Guido, R. L. Criswell and A. J. Zipay on Dec. 6, 1977 and assigned to Foster Wheeler Energy Corporation one of the coassignees of the present application. In that steam mixing system, the steam outflows from two boilers are mixed in a header and then directed to a high pressure turbine, but no disclosure is provided on how the steam flows are blended during startup or shutdown of one boiler while the other boiler is fully operational.

The provision of system control for the blending of steam presents special problems especially during the startup of an off-line boiler and the transfer of steam flow demand to it. In particular, it is desirable that steam blending be achieved with stable plant operation, i.e. without upsets to steam pressure and temperature.

SUMMARY OF THE INVENTION

An electric power plant control system controls the blending of steam from the output of at least one off-line boiler with the outlet steam from an on-line boiler. Each boiler has a high pressure turbine bypass valve and an isolation valve the system has means for controlling the fuel supply to the on-line boiler to satisfy steam pressure demand under varying plant load conditions. Means are provided for generating a pressure ramp setpoint for the off-line boiler and for controlling the fuel supply to the off-line boiler to satisfy steam pressure demand from said pressure ramp generating means. The actual bypass steam flow and the turbine steam flow from the off-line boiler are sensed and means are provided for controlling the off-line boiler bypass valve position to control bypass steam flow as a function of the pressure ramp setpoint.

Memory means record the outlet steam flow from the off-line boiler when boiler pressures are matched and the off-line boiler isolation valve is opened for blending of the boiler outlet steam flows. Means responsive to the memory means and the off-line boiler flow sensing means control the off-line boiler fuel supply controlling means to hold the outlet steam flow from the off-line boiler substantially constant. The the off-line boiler bypass valve controlling means are progressively operated after the off-line boiler isolation valve is opened to close the off-line boiler bypass valve and smoothly blend the off-line boiler steam flow with the on-line boiler steam flow as the on-line boiler fuel supply controlling means cuts back on on-line boiler fuel to satisfy steam pressure demand with reduced outlet steam flow from the on-line boiler.

DESCRIPTION OF THE PREFERRED EMBODIMENT

Figure 1:
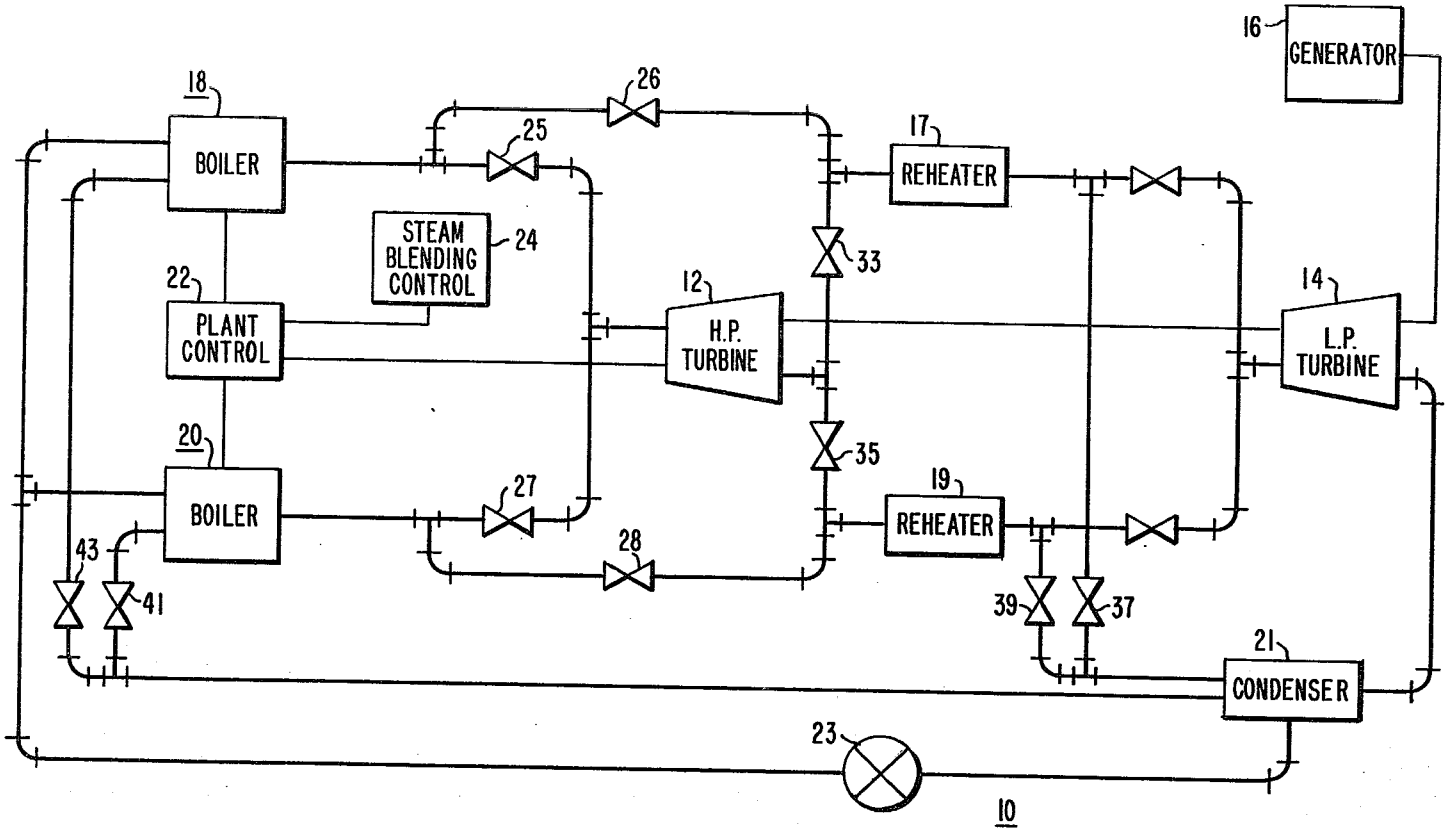
FIG. 1 shows a block diagram of a plant arranged to be controlled in accordance with the principles of the invention.

More particularly, there is shown in FIG. 1 an electric power plant 10 having a steam turbine 12, 14 which drives an electric generator 16. A pair of fossil fired steam generators or boilers 18, 20 with reheaters 17, 19 supply steam to drive the turbine 12, 14. The spent steam is returned to the boilers 18, 20 through a condenser 21 and boiler feedpump 23.

A plant control 22 provides boiler water, air and fuel control to generate steam for the turbine 12, 14 at desired pressure and temperature. The plant control 22 also operates the turbine steam admission valves to control turbine speed and load.

A steam blending control 24 is operated to control the position of high pressure boiler isolating valves 25 and 27 and low pressure isolating valves 33 and 35 and to control the amount of steam bypass flow from the boilers 18, 20 to condenser 21 through respective high pressure bypass valves 26, 28 and low pressure bypass valves 37, 39. Preferably, the control of the low pressure valves 33, 35, 37, 39 is slaved to the control of the respective high pressure valves 25, 27, 26, 28.

The blending control 24 is coordinated with other controls in the plant 10 as it stably controls the pressure and temperature conditions of the steam flow to the turbine 12, 14 from one of the boilers being brought on-line with steam from the other boiler which is on-line and fully operational. The blending control 24 also controls the shutdown of one boiler to an off-line state as the other boiler continues to function on-line in a fully operational state.

The plant 10 may be a plant in which the two boilers 18 and 20 are a part of the original plant design or one in which one of the boilers is a retrofitted boiler installed after the original plant has operated in order to provide added or backup steam generating capacity for the plant. In alternate embodiment of the invention, a plurality of turbines may be supplied by a greater plurality of boilers.

Startup of a single boiler for single boiler operation is basically the same as that for a conventional plant. Once one of the boilers is fully operational, the operator decides whether and when the second boiler is to be started to meet plant load demand. If the plant load demand is greater than 50%, the operation of both boilers is a necessity. Turbine temperature is also a consideration in the operator's decision on the number of boilers to be operated since bringing the second boiler on-line at too low a plant load demand or continuing to operate both boilers at too low a plant load demand can result in undesirable lowering of the turbine temperature. As noted previously, an off-line boiler may also be started by the operator to replace an on-line boiler for maintenance or other reasons.

Figure 2:
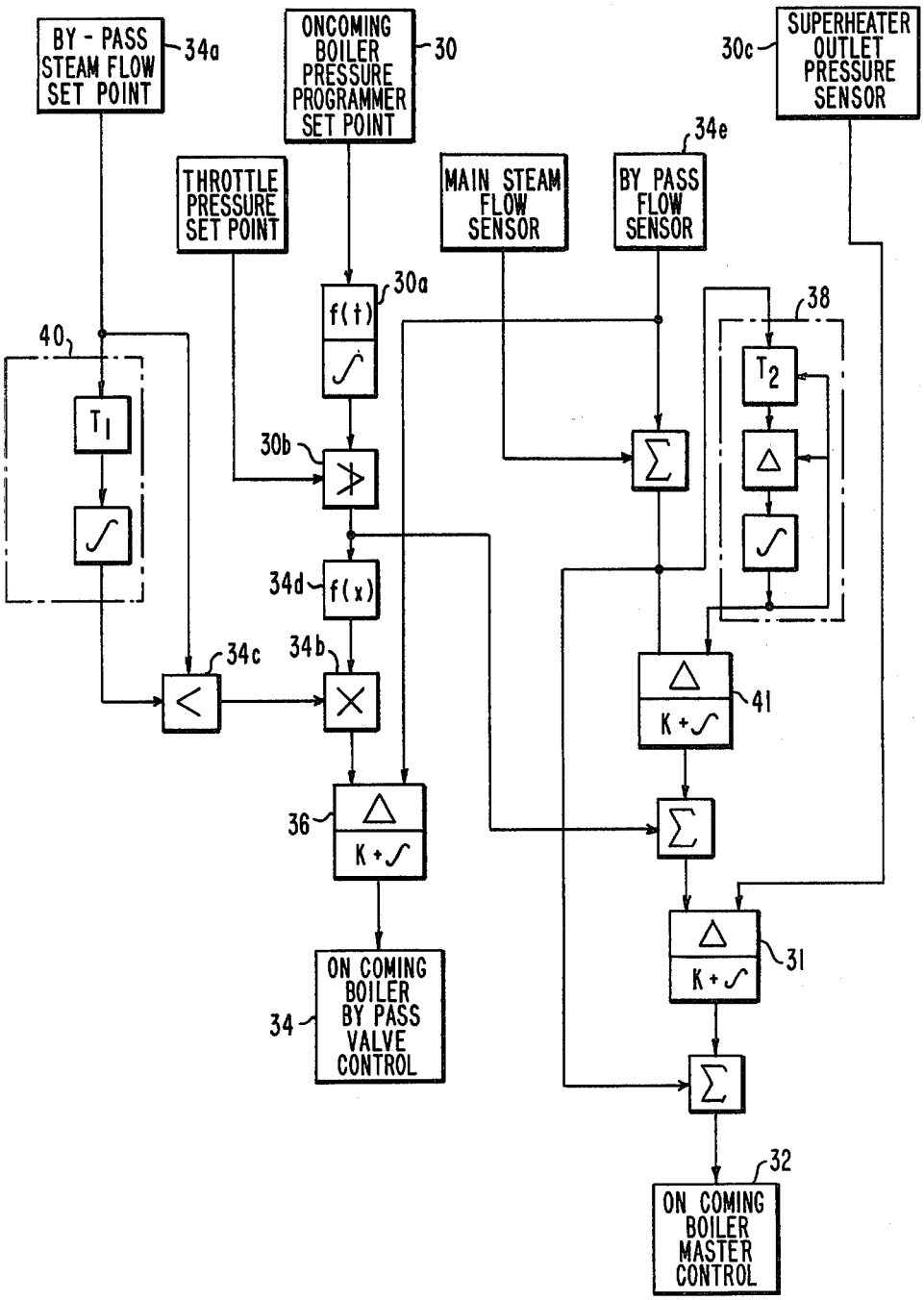
FIG. 2 shows a block diagram of a control system for the plant of FIG. 1.

With reference to FIG. 2, once one of the boilers is operating on-line and startup of the off-line boiler is initiated to aid in meeting a plant load demand which is high enough to justify or require two-boiler operation, the desired off-line boiler startup pressure setpoint is established in block 30 to cause the generation of a pressure setpoint ramp from block 30*a* with high limit action from block 30*b*. The pressure setpoint ramp is applied with a pressure feedback signal from sensor 30*c* to pressure controller 31 which causes the demand for fuel and air for the oncoming boiler to increase slowly under control of a boiler master control 32. The high limit in block 30*b* is made equal to the actual on-line or off-coming boiler pressure to provide for self alignment between the boilers during the blending operation.

Simultaneously, the bypass valves for the oncoming boiler are controlled by a position control 34 to control the bypass steam flow from the oncoming boiler. For this purpose, a bypass steam flow setpoint is generated by block 34*a* and applied to a multiplier 34*b* through a low selector 34*c*. The boiler pressure ramp signal is applied to a characterizer 34*d* which is coupled to the multiplier 34*b* to cause the multiplier 34*b* to generate a bypass steam flow setpoint ramp which is functionally dependent upon the pressure setpoint ramp in accordance with the characterization function in the block 34*d*. A suitable function for the block 34*d* is based on the flow versus rated throttle pressure curve supplied by the boiler manufacturer.

The flow setpoint multiplier output and a bypass flow signal from sensor 34*e* are applied to bypass valve controller 36. A valve position control signal is generated by the controller 36 to drive the control 34 in accordance with the valve position signal.

When the outlet steam conditions for the oncoming boiler are at the selected values and blending is desired, the operator opens the isolation valve 25 or 27 between the oncoming boiler and the main steam line. As soon as the isolation valve is not closed, block 38 of the control scheme memorizes the bypass flow for reasons which will subsequently become more apparent.

The opening of the isolation valve 25 or 27 also causes an input to an integrating unit in box 40 to transfer from the previously selected value to a value which causes the integrating unit output slowly to reduce to zero percent thereby causing the bypass valve 26 or 28 to close. As the bypass valve 26 or 28 closes, the memorized or snapshot flow value in block 38 operates as a steam flow setpoint to adjust the fuel and air flow rates through flow error generator 41, the pressure controller 41 and the boiler master control 32 so that the total flow from the oncoming boiler (the sum of the flows to the main steam line and the bypass line) remains substantially constant. When the bypass valve 26 or 28 is 100% closed, control of the oncoming boiler is completely transferred to the master boiler control 32.

The steam flow snapshot taken when the isolation valve is opened operates as a self-alignment mechanism which provides for smooth and balanced boiler operations during steam blending. This snapshot mechanism allows the steam outlets of two boilers to be piped in a parallel configuration while providing precise and stable control of the oncoming boiler steam flow contribution to the controlled total steam flow. For example, if the actual offcoming boiler pressure is measured high as a result of an instrument error, the oncoming boiler pressure will be higher than the actual offcoming boiler pressure when the oncoming boiler isolation valve is first opened. The oncoming boiler will thus produce some main line steam flow causing the total oncoming boiler steam flow to be greater than the snapshot flow value. The control system corrects this condition through the master control 32 by trim action from the flow error generator 41 on the pressure controller 31.

While the bypass valve 26 or 28 is closed and the boiler is being controlled by the master boiler control 32, block 38 is released to track the steam flow signal, and the boiler pressure programmer 30 is set to track the actual boiler outlet pressure. When circumstances are such that it is desirable to take a boiler out of service, i.e. to deblend, three things are done to initiate the action.

First, the boiler pressure programmer 30 is adjusted to a value such as 500 psi less than the operating pressure; however, the programmer 30 continues to track the measured boiler outlet pressure until the bypass valve 26 or 28 is not closed. The block 38 memorizes the flow existing at that time. Next, the bypass steam flow setpoint is adjusted to the actual flow and control of the boiler is transferred from the plant master 32 to the individual boiler control. When this transfer is completed, the block 38 memorizes the existing steam flow and block 40 transfers to the bypass flow setpoint.

As the output of block 40 slowly increases, the bypass valve 26 or 28 slowly opens. Block 38 which has memorized the total boiler steam flow adjusts the fuel and air flows so that the total flow remains substantially constant. When the bypass flow is equal to the memorized flow, the isolation valve 25 or 27 is closed and the boiler pressure programmer is released. In turn, the boiler fuel and air are gradually decreased in order to permit the boiler pressure to follow the pressure setpoint. Accordingly, both blending and deblending operations are controlled smoothly and accurately without disturbing turbine steam flow and pressure.

Figure 3A:
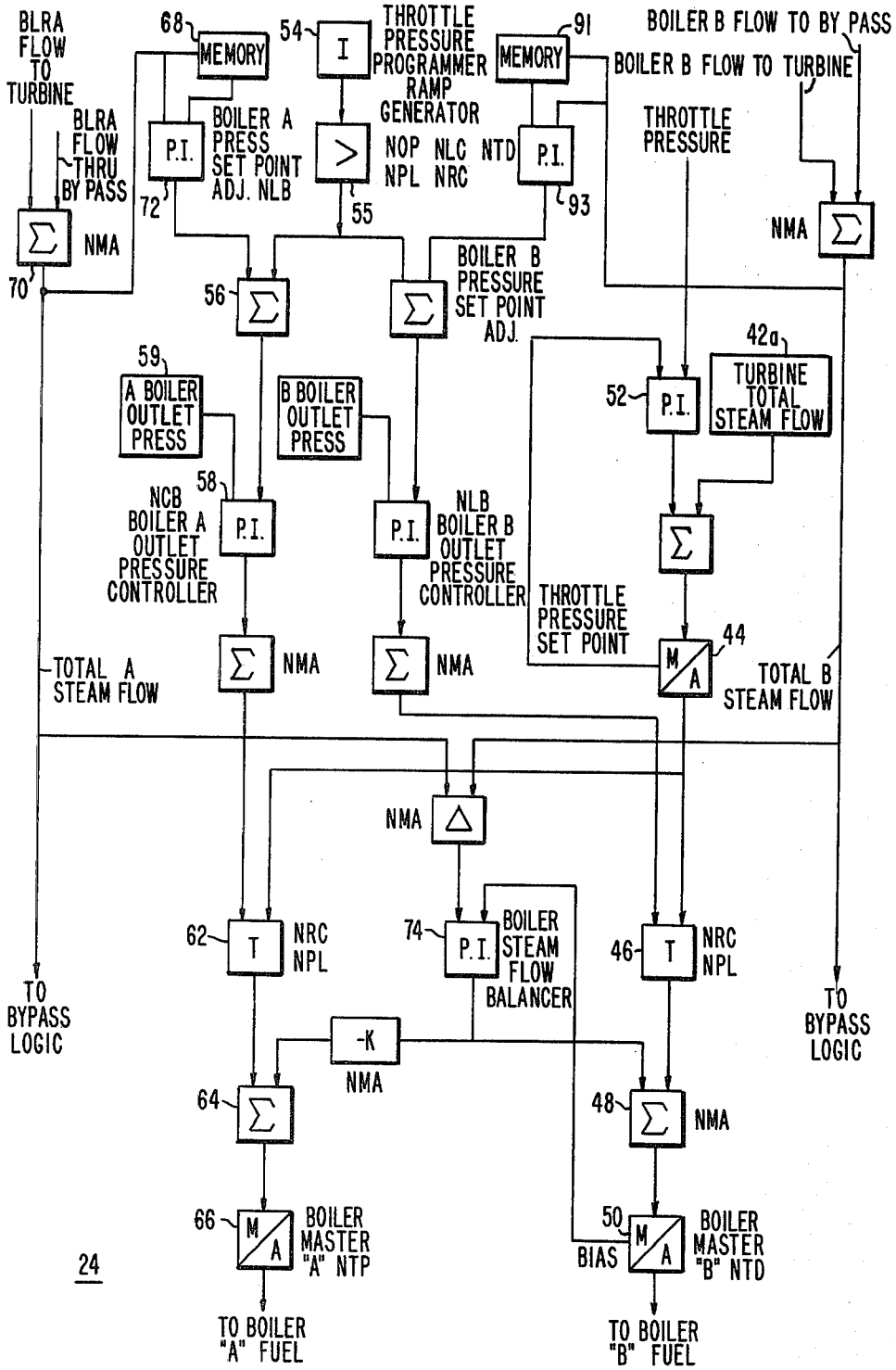
FIGS. 3A and 3B shows a more detailed embodiment of the invention.
Figure 3B:
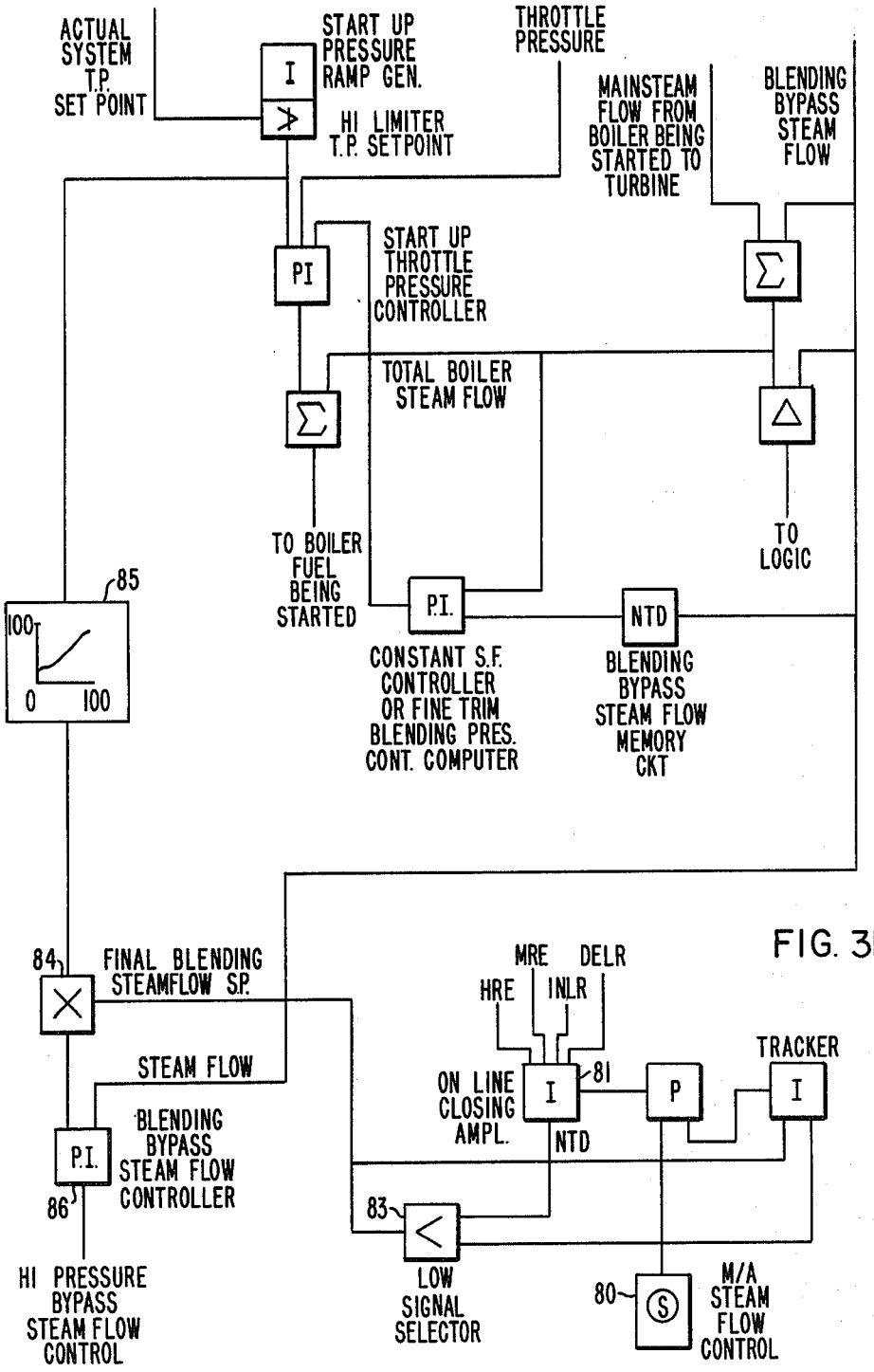

A more detailed embodiment of the invention is shown in FIGS. 3A–3B and 4A–4C. In FIGS. 3A–3B, the blending control 24 is shown in functional block form with the circuit card mnemonic designated for each functional block in correspondence to the schematic-circuit cards shown in FIGS. 4A–4C. For description purposes, the two boilers 18 and 20 are designated in FIGS. 3A–3B and 4A–4C as boiler A and boiler B and boiler A is assumed to be oncoming with boiler B on-line.

The on-line boiler B controls from a boiler follow control system. Total turbine steam flow 42*a* is used as a fuel load index to the boiler. Thus, the steam flow signal is applied through summator 42*b*, a master manual/automatic (M/A) station 44, a transfer relay 46, another summator 48, and a B boiler M/A master control 50 to generate a fuel demand for the boiler B. The fuel demand is trimmed by a throttle pressure controller 52 which supplies a plus or minus adjustment signal to the summator 42 to assure that the boiler B operates at rated pressure.

To start the off-line boiler A, the operator first selects a steam flow (FIG. 3B) for the oncoming boiler which thus defines a bypass steam flow setpoint. The throttle pressure programmer 54 then increases the throttle pressure setpoint linearly as a function of time. The boiler responds to the pressure setpoint ramp to generate added steam with increasing fuel. The bypass valve 26 or 28 modulates to regulate the increasing bypass steam flow with increasing pressure.

Generally, the A boiler throttle pressure setpoint is ramped as a function of time to rated pressure, approximately 2400 psi. Increased pressure demand results in boiler master control 66 causing fuel to be added to the boiler A.

The final steam pressure of boiler A should match that of the on-line boiler B. A high limiter 55 acts as prealignment limiter to aid in self-alignment by preventing the oncoming boiler setpoint from exceeding the on-line boiler pressure setpoint.

When the oncoming boiler pressure has been brought up to 2400 psi, no steam flow to the turbine (blending) has yet occurred since the turbine isolation valves are closed.

The oncoming A boiler is brought from a startup condition to rated pressure by the throttle pressure programmer 54 which provides an output representing throttle pressure setpoint on a smooth time ramp as a function of time. The output from the throttle pressure programmer operates through a summator 56, a boiler outlet pressure controller 58, a summator 60, a transfer 62 which selects the startup circuit or the master station 44, a summator 64, and the boiler master A M/A station 66 to generate a demand for boiler A fuel.

An outlet pressure controller 58 for the boiler A compares demand for boiler A header pressure against the actual measured header pressure 59. The boiler A fuel is adjusted by the controller 58 as required to satisfy the steam pressure demand.

After the oncoming boiler has been started and brought to matched steam conditions with the on-line boiler B blending may be initiated at which time a memory device 68 is triggered by an isolation valve logic circuit to memorize the total A boiler steam flow indicated by summator block 70. The total steam flow equals the boiler A flow to the turbine, which is zero at start of blending, plus the boiler A bypass flow. Thereafter, boiler A pressure setpoint adjustment controller 72 compares the memorized constant steam flow against the actual total boiler A steam flow, and any error in the total steam flow results in the controller 72 generating a throttle pressure correction to the A boiler pressure controller 58 through the summator 56.

Once both boilers are on line, a steam flow balancer 74 maintains the boilers at the same steam flow or allows an offset in accordance with a bias adjustment on the B boiler master control 50.

As previously indicated, the high pressure bypass control valves are controlled during blending to reduce the oncoming boiler bypass steam flow. To maintain proper oncoming boiler temperature in both the superheater and the reheater, the steam flow from the finishing superheater is bypassed by the high pressure bypass control valve to the reheater input of the same boiler. The steam then goes through the reheater where it is subsequently further bypassed to the condenser.

The low pressure bypass control valve routes the bypass steam to the condenser. This valve is piped between the output of the oncoming boiler reheater and the condenser. The control of the low pressure bypass valve is slaved to be a ratio of the high pressure bypass valve position.

Preferably the operator adjusts a setpoint pot in block 80 (FIG. 3B) for the final steam flow required from the oncoming boiler after blending has occurred. The flow must be set high enough so that the oncoming boiler will produce enough steam to maintain steam temperature at 1000° F., but not so high that after blending the on-line boiler load would be reduced to a level that steam temperature drops.

Prior to blending, the steam flow setpoint 80 defines the bypass steam flow and it is thus applied to a low signal selector 83 and a multiplier 84 to generate the blending bypass steam flow setpoint which operates through a blending bypass steam flow setpoint controller 86 to position the high pressure bypass valve. The multiplier 84 accurately repeats the operator setpoint value if the pressure setpoint is at rated pressure. When the plant is at low pressure (just being started) the steam flow is only approximately 10% of the operator setting thereby preventing too much steam from being drawn too soon. High steam flow too soon at a low pressure makes it more difficult to raise pressure and also wastes fuel since the steam goes to the condenser.

As the throttle pressure setpoint increases, the characterization curve $F_x$ in block 85 (like block 34*d* in FIG. 2) increases the gain of the multiplier 84. The gain becomes one at rated pressure, resulting in the steam flow setpoint being equal to the operator adjustment value.

At this point, no steam blending has occurred. The on-line boiler B is supplying useful steam to the turbine and the oncoming boiler A is producing steam at proper pressure and temperature through the bypass valve 26.

To initiate blending, the operator opens the isolation valves 25 and 33. To avoid any abrupt changes to the process, it is desirable that no steam flow through the valves 25, 35 when they are opened.

A no-flow condition occurs only if the oncoming boiler pressure has been accurately controlled in the context of physical process drift or load changes. Prior to the opening of isolation valve 25, all steam from the oncoming boiler A flows through the bypass valve 26. At the instant the valve 25 is opened, the total steam flow is memorized as previously described. The flow through the bypass valve cannot change as it is regulated by the blending bypass steam flow controller 86. Therefore, any change in the total oncoming boiler steam flow occurs through the opened isolation valve 25.

Flow correction is obtained by fine adjustment of the oncoming boiler throttle pressure. The steam flow controller compares actual total steam flow against the memorized flow and slowly modifies the setpoint for the start-up throttle pressure controller 58. Thus, the oncoming boiler throttle pressure is fine adjusted to allow the boilers to be interconncted with zero flow from the oncoming boiler.

In addition, compensation is provided for drifting or changes to the process. For example, a required on-line boiler/turbine load change during blending changes boiler outlet pressure and pressure drops within the piping. Any changes to the total flow due to the load changes results in the boiler master control for the on-line boiler adjusting the on-line boiler fuel supply to satisfy the new load demand. Simultaneously, the oncoming boiler control acts in a slave relationship to cause an adaptive fine recalibration of the oncoming boiler throttle pressure.

The purpose of the blending control is to transfer smoothly the steam from the oncoming boiler A from the bypass flow path to the turbine without disturbance to steam pressure or temperature. This ultimately results in both boilers becoming on-line and supplying steam to the turbine. In order not to change turbine load, the on-line boiler steam flow is reduced by the amount added by the oncoming boiler. This reduction occurs from the temporary increase in throttle pressure due to the added steam flow from the oncoming boiler.

The blending action can be viewed as a series of step changes in the process. Thus, the oncoming bypass valve is pinched back a small amount to produce a blending step. As a result the turbine inlet pressure increments up above normal and the primary steam flow increments down. Fuel is then incremented down on the on-line boiler by its master control thereby causing the turbine inlet pressure to increment down to normal and the on-line boiler steam flow to increment down by the amount that the oncoming flow had been incremented upwardly. These step adjustments are repeated until the boiler flows are in accordance with the operator selections.

Controlled closure of the bypass valve 26 occurs during blending as follows. Prior to the initiation of blending, bypass steam flow is equal to the operator setting in block 80. An on-line closing amplifier 81 tracks the operator setting 80 to assure that the tracker is ready to operate. Thus, both inputs to a low signal selector 83 are equal and the output from the low signal selector 83 is equal to the operator setting in block 80.

Upon initiation of blending, the output from the integrator 81 linearly and slowly ramps from the operator setting in block 80 to zero. The low signal selector selects this lower value and ramps the final blending steam flow setpoint from the operator value to zero. Accordingly, the valve 26 is caused to close progressively, thus slowly diverting the steam flow from the bypass flow path to the turbine.

As the oncoming steam diverts from the bypass path to the turbine, the turbine load pressure tends to increase causing the on-line boiler load to be reduced. As the on-line boiler load drops, a minimum load is reached where steam temperature can no longer be maintained. This temperature drop is sensed and the steam temperature control valve (not shown) is opened to divert steam from the superheater, thereby removing coolant action on the superheater and restoring the on-line boiler outlet steam temperature. This allows further drop in the on-line boiler steam flow while maintaining steam temperature. An "A" valve (not shown) counteracts and controls the natural boiler characteristic to drop steam temperature for less than 50%.

As plant load drops during blending, the steam temperature tends to drop accordingly. To prevent a drop in steam temperature, the steam temperature control valve is again used for steam temperature control, i.e. to leak steam from the superheater to the condenser. This allows maintenance of superheat temperature for plant loads less than 50%. When the temperature control valve position becomes greater than 50% it reaches the end of its control range, additional ability to maintain steam temperature for further load reductions is severely limited and blending is halted by logic control. When the temperature control valve reaches 65% open position logic controls cause deblending of the oncoming boiler to be initiated.

Deblending is the reverse of blending and is used to take one boiler out of service. The operator must first be sure the turbine steam load is within the capacity of the boiler to remain on line. The operator can drop the load further on the offcoming boiler as low as practical. However, the reduced loading should be within the flow capacity of the bypass valve. The operator adjusts the steam flow setpoint knob to equal the actual steam flow.

Transferring to deblend causes the steam flow to be memorized in block 91 (FIG. 3A) and activates the controller 93. The demand for steam flow from 81, 83 is zero and the bypass valve 28 is closed. The output from 81, 83 increases slowly and linearly with time causing the blending bypass steam flow controller 86 to open the bypass valve 28.

Ultimately, the bypass valve 28 is completely open, and steam flow is diverted to the bypass flow path. The isolation valve 27 is then closed and the offcoming boiler is off-line. All during this process, the fine trim controller 93 uses the memorized steam flow to fine trim the offcoming boiler throttle pressure and assure proper steam flow diversion.

Figure 4A:
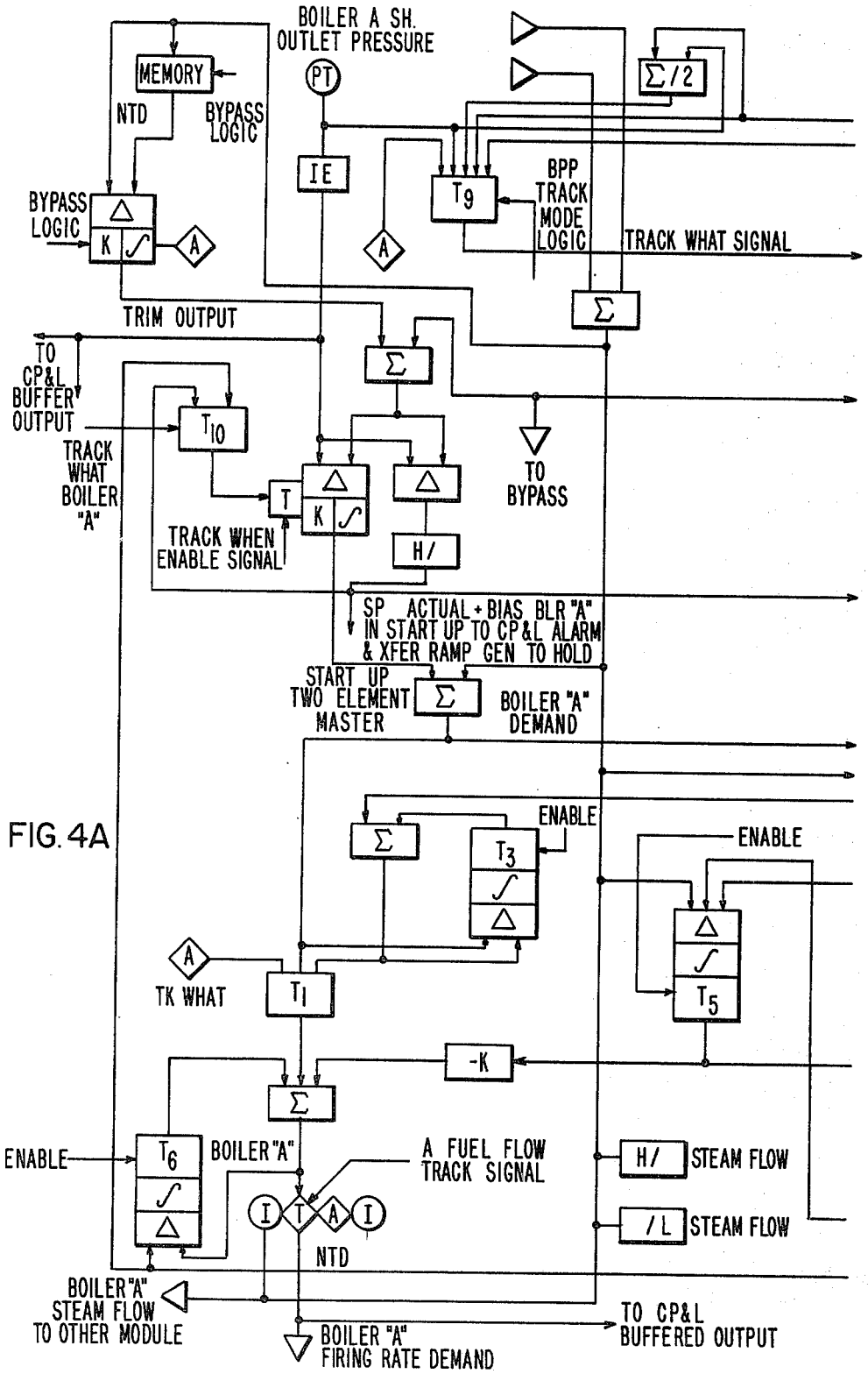
FIGS. 4A–4C show the embodiment of FIGS. 3A—3B in still greater block detail.
Figure 4B:
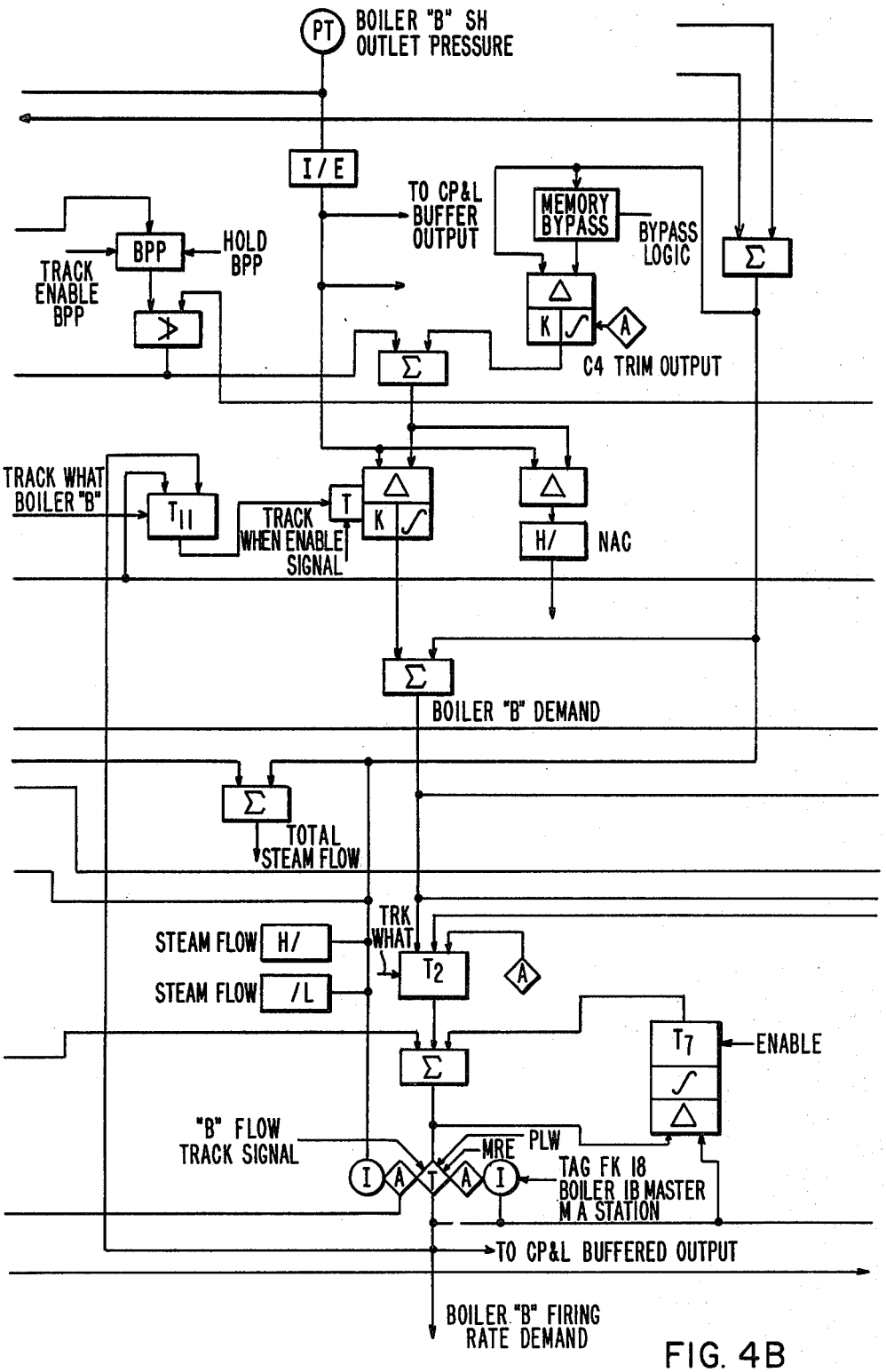
Figure 4C:
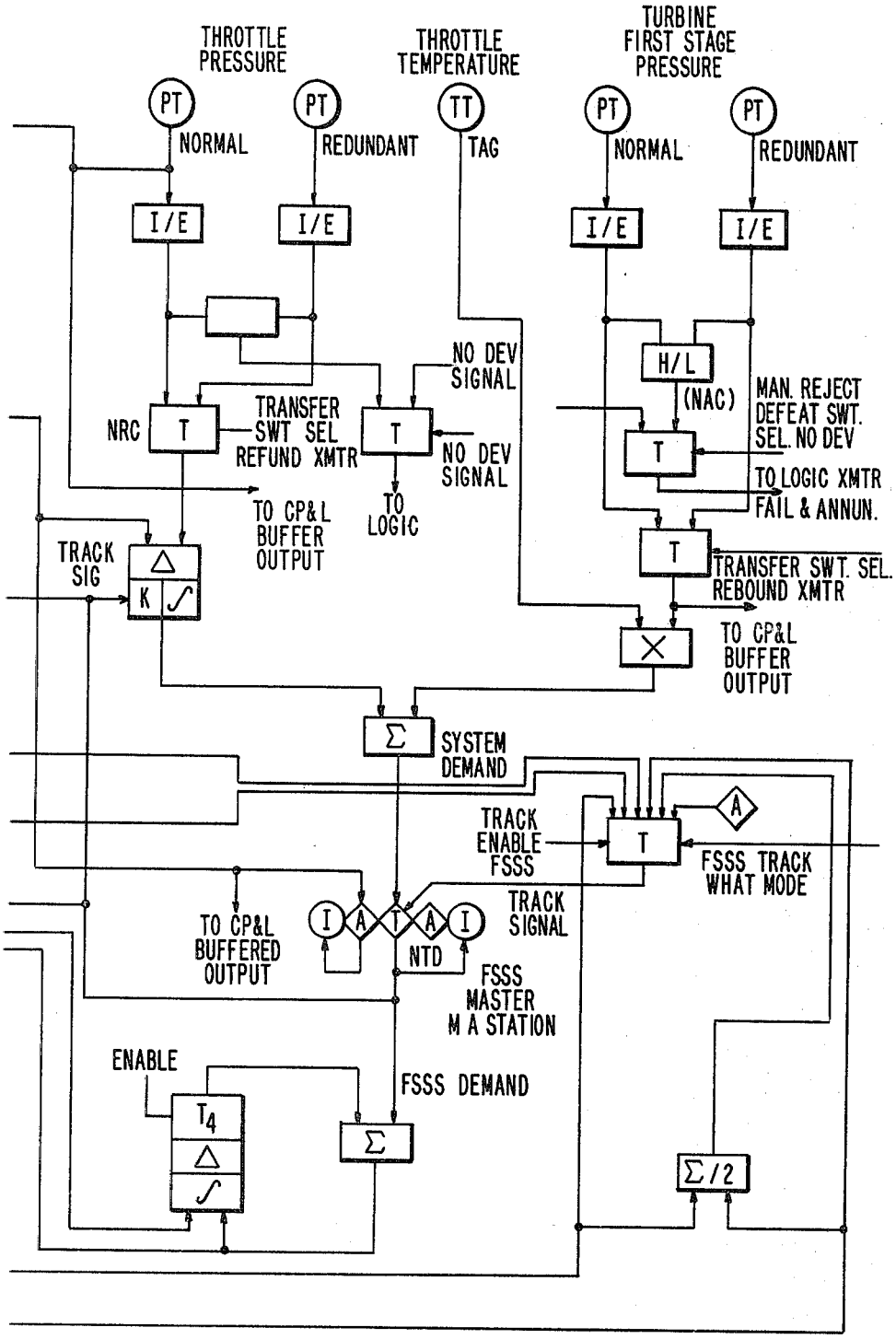
Figure 5:
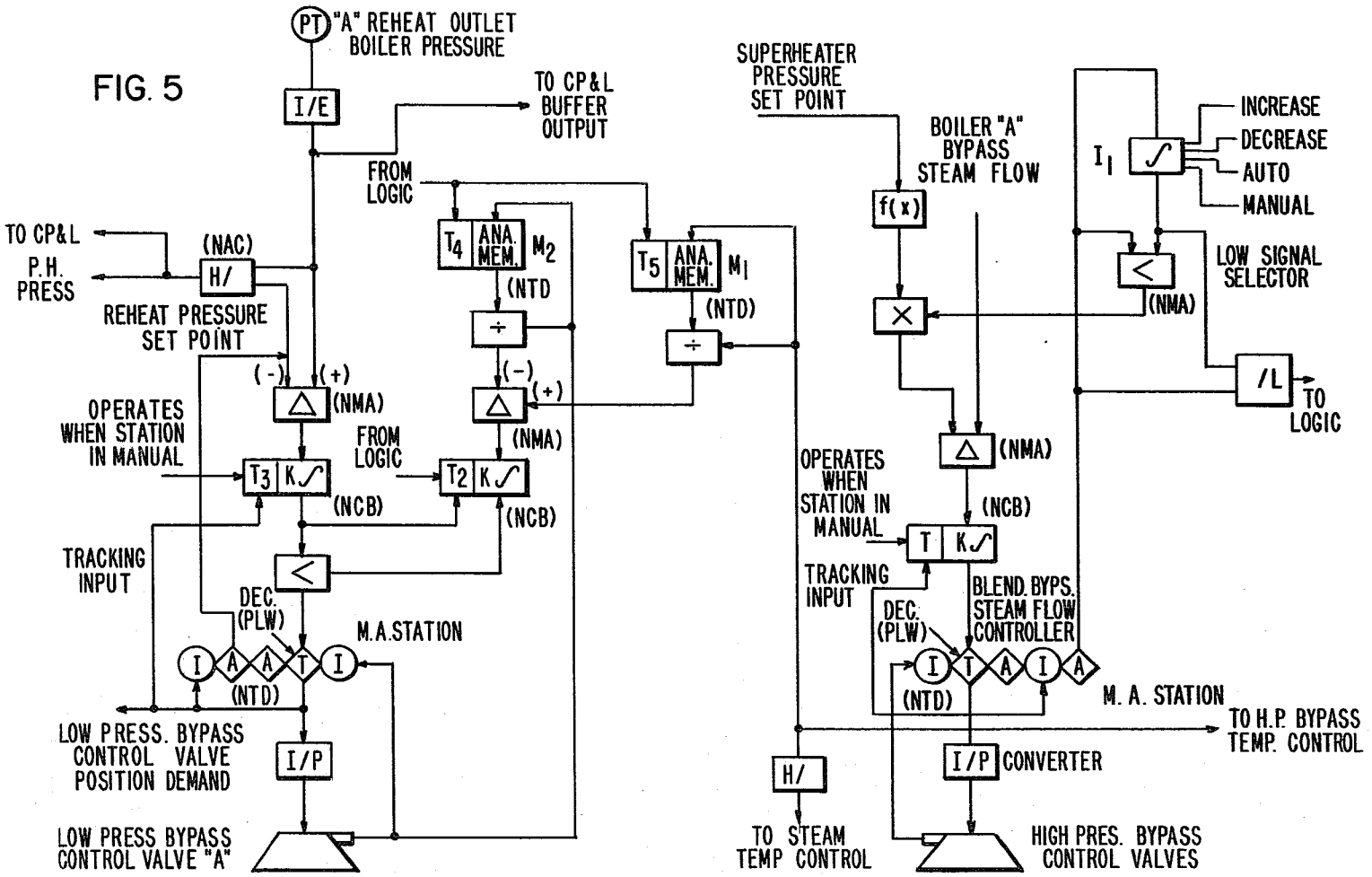
FIG. 5 shows a control block diagram for high and low pressure bypass valves.
Figure 6:
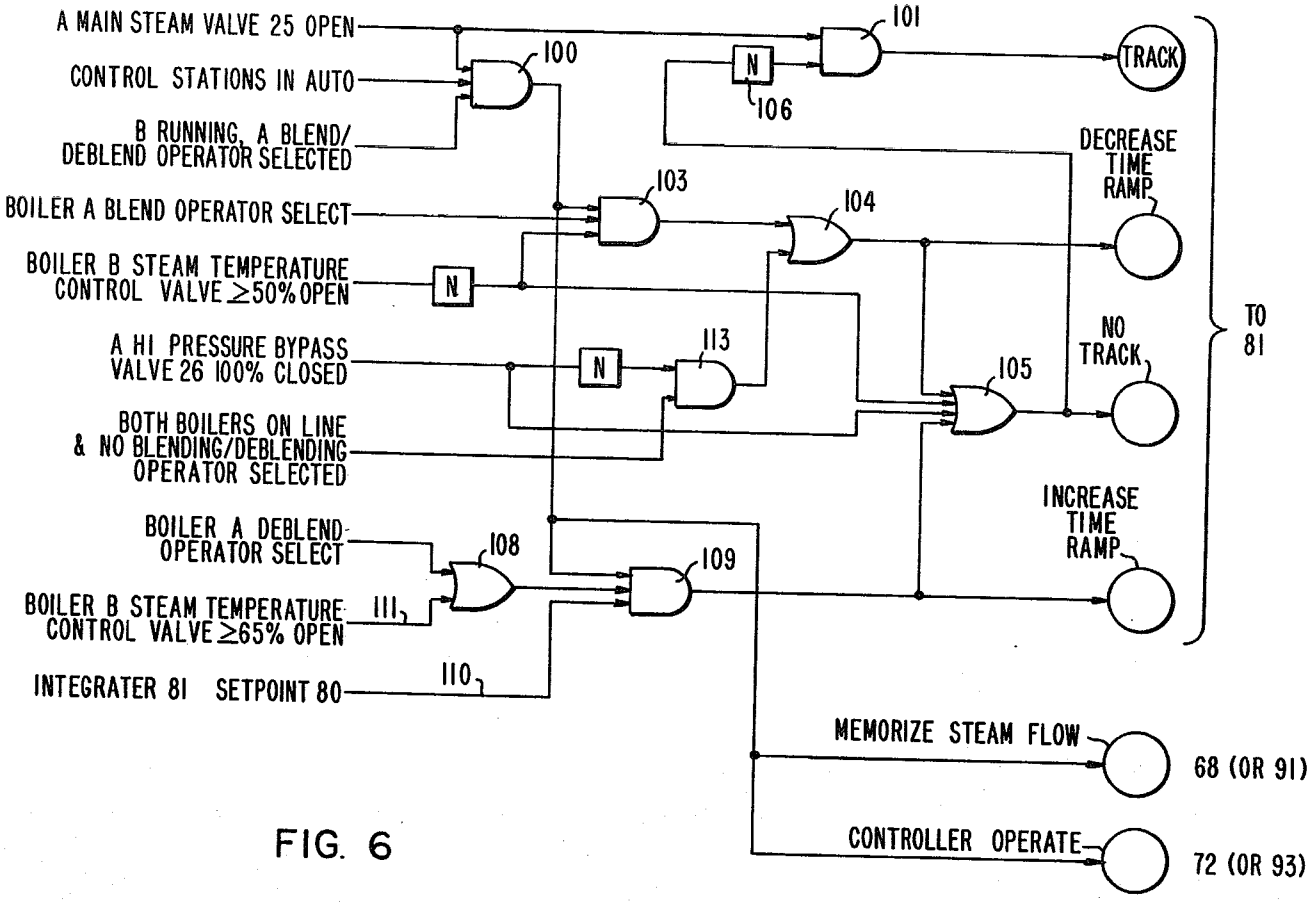
FIG. 6 shows a logic system for the embodiment of FIGS. 3A—3B.

The invention embodiment shown in FIGS. 3A and 3B is illustrated in greater functional block detail in FIGS. 4A–4C. FIG. 5 shows the manner in which the low pressure bypass valves are slaved to the high pressure bypass valves. FIG. 6 shows logic circuitry for the blending control and it is tied to the various control blocks as shown in FIGS. 4A–4C. Standard commercially available circuit cards are employed for the various functional blocks shown in FIGS. 4A–4C, 5 and 6.

The logic control circuitry is adapted to enable the blending system to operate discontinuously. Thus, the blending system can operate in a blend mode, a deblend mode, or it can be totally disengaged when not required. As previously described, the system while blending may also stop or even reverse and deblend should the load of the on-line boiler drop too low toward the minimum load which will allow maintenance of rated steam temperature.

The logic is performed primarily with a standard commercially available circuit card referred to as an NPL card. Another standard card referred to as an NAC card provides analog to digital logic conversion.

Logic is provided to control properly the on-line closing amplifier 81 in FIG. 3B. Prior to blending, the amplifier 81 tracks the M/A steam flow setpoint 80 to assure proper alignment. During blending (or deblending), the amplifier output linearly ramps closed (or open) to position properly the high pressure bypass valve. Lastly, during blending, the amplifier 81 stops closure and reverses to open the high pressure bypass valve should the on-line boiler load drop so low as to risk loss of steam temperature.

In FIG. 6, it is assumed that boiler B is on-line and boiler A is ready to blend. The logic controls the amplifier 81 as follows:

(1) The operator prepares plant conditions for blending by placing relevant control stations in auto, opening the A main steam valve 25 and having the B boiler on follow control, and the A boiler not on follow control.

This operator preparatory action in turn completes permissive block 100 and causes the amplifier 81 to track the operator setpoint 80.

(2) Operator selection of a blending action, and boiler B steam temperature valves not ≧50% open completes block 103, and repeats through OR block 105 to initiate no further tracking and to block track command through NOT block 106 and AND block 101. Normal operation eventually ramps the amplifier 81 to zero to close the bypass valve 26.

(3) If the boiler B backs off too much and tends to lower steam temperature the B steam temperature control valve opens. An opening ≧50% causes a NOT block 107 to stop the closure. If the valve opens ≧65% an OR block 108 plus AND 109 reverse the closing action of the amplifier 81. The amplifier 81 then opens until either the valve is not >65% or not <the manual setpoint 80 at input 110.

(4) An AND block 113 causes the integrator to keep the valve 26 closed once it is closed and both boilers are on-line and no blending/deblending is required.

(5) Deblend makes use of the same hardware. The operator prepares the plant for deblending by placing the appropriate control stations in auto and selecting A boiler deblending with B boiler on-line. The A main steam valve 25 is already open.

(6) Selecting deblend initiation results in OR block 108 plus AND block 109 causing the integrator 81 to open the bypass valve 26. The setpoint increases until the integrator 81 is aligned with the manual setting 80, at which time signal 110 through the AND block 109 stops further opening.

(7) Signals 110, 111 and 112 are generated by analog to digital converters. The remaining logic is done with NPL.

The logic additionally activates the memory 68 (or 91) and the pressure setpoint adjust controller 72 (or 93) in FIG. 3A. When the memory is not used and is tracking the steam flow, the controller tracks zero to have no influence on boiler pressure. When the memory is activated, the controller is released to operation. The permissives which activate the AND block 100 cause the memory 68 (or 91) to memorize steam flow, and release the controller 72 (or 93).

What is claimed is:

1. An electric power plant control system for controlling the blending of steam from the output of at least one oncoming boiler with the steam from the output of an on-line boiler, each boiler having a high pressure turbine bypass valve and an isolation valve, said system comprising means for controlling the fuel supply to the on-line boiler to satisfy steam pressure demand under varying plant load conditions, means for generating a pressure ramp setpoint for the oncoming boiler, means for controlling the fuel supply to the oncoming boiler to satisfy steam pressure demand from said pressure ramp generating means, means for sensing actual bypass steam flow and turbine steam flow from the oncoming boiler, means for controlling the oncoming boiler bypass valve position to control bypass steam flow as a function of the pressure ramp setpoint, means for sensing and comparing the outlet boiler pressures, memory means for recording the outlet steam flow from the oncoming boiler when boiler outlet pressures are matched and the oncoming boiler isolation valve is opened for blending of the boiler outlet steam flows, means responsive to said memory means and said oncoming boiler flow sensing means for controlling said oncoming boiler fuel supply controlling means to hold the outlet steam flow from the oncoming boiler substantially constant, and means for progressively operating said oncoming boiler bypass valve controlling means after the oncoming boiler isolation valve is opened to close the oncoming boiler bypass valve and smoothly blend the oncoming boiler steam flow with the on-line boiler steam flow as said on-line boiler fuel supply controlling means cuts back on on-line boiler fuel to satisfy steam pressure demand with reduced outlet steam flow from the on-line boiler.

2. A control system as set forth in claim 1 wherein said memory means records the outlet blended steam flow from the oncoming boiler after it is partially or fully brought on-line and a deblending action is initiated to change the status of the oncoming boiler to an offcoming boiler, means are provided for progressively opening the offcoming boiler bypass valve until the offcoming boiler bypass flow equals the recorded blended flow value at which time the offcoming boiler isolation valve can be closed, said responsive means responding to said memory means and the offcoming boiler flow sensing means to cause the offcoming boiler outlet steam flow to be held substantially constant and equal to the recorded blended flow value during the deblending process.

3. A control system as set forth in claim 1 wherein means are provided for high limiting oncoming boiler pressure setpoint to the actual on-line boiler outlet pressure.

4. A control system as set forth in claim 1 wherein a low pressure turbine bypass valve and isolation valve are provided in association with each boiler, and means are provided for slaving the operation of the low pressure values to the operation of the high pressure valves.

5. A control system as set forth in claim 1 wherein logic circuit means are provided for implementing operator mode selections and predetermined protective limit control actions.

* * * * *